US006240595B1

(12) United States Patent
Dupuy

(10) Patent No.: US 6,240,595 B1
(45) Date of Patent: Jun. 5, 2001

(54) APPARATUS FOR REMOVING COATINGS FROM DECK TIEDOWNS ON MARINE VESSELS USING ULTRA HIGH PRESSURES WATERJETTING

(75) Inventor: Richard Kim Dupuy, Newport News, VA (US)

(73) Assignee: UHP Projects, Inc., Newport News, VA (US)

( * ) Notice: Subject to any disclaimer, the term of this patent is extended or adjusted under 35 U.S.C. 154(b) by 0 days.

(21) Appl. No.: 09/400,259

(22) Filed: Sep. 21, 1999

(51) Int. Cl.[7] ..... B05B 1/28

(52) U.S. Cl. ..... 15/302; 15/304; 15/321; 15/322; 15/345

(58) Field of Search ..... 15/302, 321, 322, 15/304, 345

(56) References Cited

U.S. PATENT DOCUMENTS 3,161,900 * 12/1964 Hornschuch et al. ..... 15/345
3,678,534 * 7/1972 Hilbig ..... 15/345
4,037,290 * 7/1977 Rose et al. ..... 15/345
4,168,562 * 9/1979 Maasberg ..... 15/322 X
4,670,062 * 6/1987 Lester ..... 15/322 X
5,321,869 * 6/1994 Kaempf ..... 15/322
5,706,548 * 1/1998 Schabacker ..... 15/345 X
5,991,968 * 11/1999 Moll et al. ..... 15/322

FOREIGN PATENT DOCUMENTS

744466 * 2/1956 (GB) ..... 15/345

* cited by examiner

*Primary Examiner*—Chris K. Moore

(57) ABSTRACT

A method and apparatus for removing coatings from all surfaces of a deck tiedown on a marine vessel (ships) using an ultra high pressure waterjetting and a vacuum attachment to contain the effluent water and debris. A rotating ultra high pressure nozzle designed to clean all areas of the tiedown by being manipulated in multiple directions and elevations is enclosed in a pressure receiver that seals to the deck surface. All removed coatings, paint, rust, and deposits are removed to a remote vacuum recovery system. This method cleans all areas of the tiedown with no damage to the substrate and provides a superior surface for the application of coatings with no detrimental effects to surrounding deck areas and eliminating foreign object damage to surrounding equipment.

7 Claims, 6 Drawing Sheets

APPARATUS FOR REMOVING COATINGS FROM DECK TIEDOWNS ON MARINE VESSELS USING ULTRA HIGH PRESSURES WATERJETTING

BACKGROUND OF THE INVENTION

1) Field of the Invention

Figure 1:
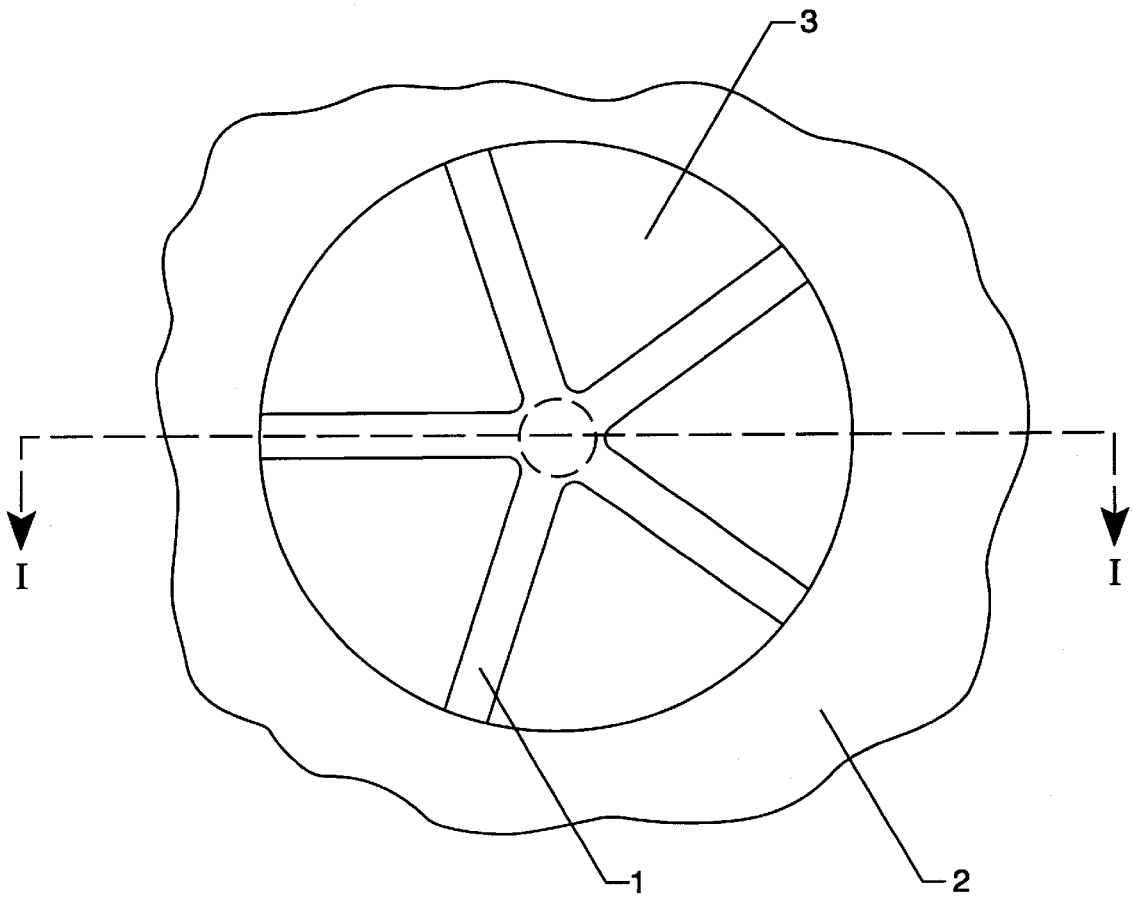
FIG. 1 typical tiedown with parts labeled
Figure 1A:
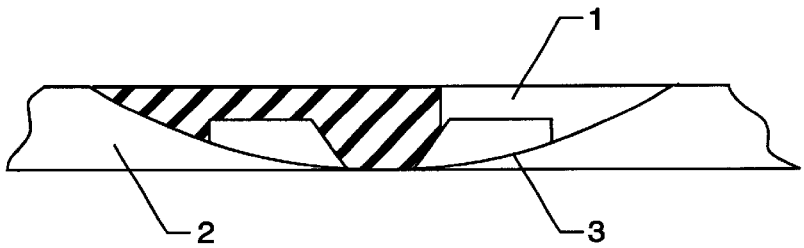
FIG. 1A sectional view of tiedown

This invention contains a method and device for using ultra high pressure waterdets contained within a vacuum shroud to remove coatings and other materials from deck tiedowns (see definition below). The device would be used on all interior and exterior decks of marine vessels (ships) containing tiedowns. Deck tiedowns are units permanently attached and incorporated into the deck either raised or recessed below the deck and are used to firmly attach items to the deck by means of chains, straps, binders, etc. Tiedowns are also known as padeyes, cloverleaves, D-rings, etc and come in several different designs. The typical parts of a tiedown as shown in FIGS. 1 and 1-A are the crossbars which are used to tie equipment down and the recessed cup which is either recessed below the surrounding deck surfaces 2 or elevated above the surrounding deck areas. These tiedowns are typically spaced 6–8 feet apart on the deck surface and typically cover the entire deck area on cargo decks, flight decks, hanger decks, weather decks, interior decks, trailer decks, etc of marine vessels.

2) Description of Prior Art

The cleaning of tiedowns for recoating purposes is usually accomplished as part of the deck maintenance program. The marine environment is extremely demanding on coatings and salt water is routinely trapped in the recessed areas of these tiedowns. The mechanical attachment of equipment to these tiedowns also damages coatings and leaves them susceptible to corrosion. Because the underside areas of the tiedowns are difficult to access they have historically not received proper surface preparation prior to recoating and preservation.

This poor surface preparation can cause repetitive cleaning and recoating which increases the cost of deck maintenance. Corrosion in these areas can cause premature deck failures and the loss of flight deck certification. Cleaning methods utilizing solid abrasives have been suspected of leaving foreign matter on decks which may cause engine damage to aircraft and other machinery located on the deck. This Foreign Object Damage (FOD) has caused the loss of many aircraft both fixed wing and helicopters.

Currently there are three existing methods of cleaning tiedowns during deck maintenance procedures:

1. The use of power handtools consisting of needleguns, sanders, flapper wheels, etc. are the most common methods of cleaning tiedowns. These handheld methods use mechanical abrasion to impact the area to be cleaned and remove unwanted coatings. These methods offer several disadvantages. Because they are handheld and bulky, the hard to reach underside areas of the tiedowns usually are not properly cleaned. The mechanical abrasion can impact surface contaminants such as chlorides, ferric oxide, and dirt into the abraded surface of the steel. These contaminants have been proven to cause premature failure of the coatings, especially in marine environments. The dust created by this mechanical abrasion also can be deposited on nearby clean steel causing contamination problems and recleaning costs. This method of cleaning is also slow and extremely labor intensive usually causing delays and coordination problems during the deck maintenance procedures.
2. Abrasive blasting procedures consisting of both open blasting and contained devices is another method employed to clean tiedowns. These methods use an abrasive such as aluminum oxide, steel shot, etc. propelled at the surface by either mechanical or pneumatic means. The high velocity abrasives abrade the steel surface removing the existing paint. This abrasion can also cause trapped contaminants which can cause premature coatings failures. The abrasives can also escape containment and get into surrounding clean areas causing contamination problems. Because of the complex geometry of the tiedowns the abrasives can also rebound and become a hazard to anyone in the area. On abrasive equipment that is self-propelled the cleaning rates of the tiedowns are slower than the surrounding flat deck and the operator may have difficulty adjusting the speed of the device causing the tiedowns to be improperly cleaned. This then requires the recleaning of the tiedown usually with the mechanical methods discussed above.
3. Open blasting using handheld ultra high pressure watedjets has been used to clean tiedowns in recent years on a limited basis. This generally consists of a handheld device that the operator places into the tiedown to remove the existing paint. This method eliminates many of the contaminant and abrasive problems but causes excessive amounts of water on the deck. This effluent water and paint debris has to be removed from the deck prior to recoating either the tiedowns or the surrounding deck. This delays the recoating process and possibly allows the formation of flashrust on the surfaces which also has to be removed prior to recoating. Automated self-propelled ultra high pressure watedjetting devices have been developed recently as noted below which use vacuum to contain the effluent water. These devices propel themselves on the deck surface and use a rotating bar or nozzle in a level plain parallel to the deck surface to clean the flat areas of the deck. These devices do not allow the manipulation of the nozzle into the tiedown and therefore do not clean the underside areas of the tiedowns. If the tiedowns are run over with these devices the paint and contaminants on the underside of the crossbars and the bottom of the cup areas are not removed and these areas have to be recleaned usually with the mechanical methods described above in 1. In addition to this problem, the seal that attaches the moving device to the deck usually losses its sealing properties as it crawls over the recessed or raised tiedowns and allows water to escape onto the clean deck. Some examples of this prior art are: U.S. Pat No. 4,809, 383 3/1989 Urakami, Fukashi DEVICE CAPABLE OF SUCTION-ADHERING TO A SURFACE AND MOVING THEREALONG discloses a device that uses vacuum to attach a self crawling system to a flat surface. The device has a traveling function and a nozzle that is rotated about an axis that is perpendicular to the wall surface and travels parallel to the surface.

BRIEF SUMMARY OF THE INVENTION

The preferred embodiment of this invention is a portable unit designed to remove existing coatings from all surfaces of deck tiedowns on marine vessels using ultra high pressure watedjetting with a means of containing all effluent water and debris within a vacuum attached system. The unit is comprised of a mode of delivery for the watedjets to the surface that is completely adjustable in all angles and elevations. A means of applying a vacuum to a chamber that encloses the watedjet nozzle body within a pressure receiver that is caused to vacuum adhere to the deck surface through means of a flexible seal. A means of removing the effluent water and debris away from the surface to be cleaned. A means of disengaging the vacuum from the system that allows the device to be moved to another location.

Another preferred embodiment of the device would consist of at least one ultra high pressure waterjetting nozzle body, the construction of which will be discussed later, that delivers ultra high pressure watedjets to the surface to be cleaned, striking the surface to be cleaned in much the same manner as small solid particles. These high velocity waterjets literally explode with the energy release shearing away unwanted materials from the surface to be cleaned. Ultra High Pressure waterjetting is defined by the Steel Structures Painting Council in its publication titled "Surface Preparation and Cleaning of steel and other Hard metals by High and Ultrahigh-Pressure water Jetting prior to Recoating," in Section 2.1.6 as: "cleaning performed at pressures above 25,000 PSI or 170 Mpa." This pressure can be delivered to the nozzle body by any pump capable of supplying these pressures from a remote location through either a flexible or stiff tubing capable of handling these pressures.

This ultra high pressure nozzle body would be rotated pneumatically, mechanically or by hydraulic means about a central axis that is completely movable in a variety of angles and elevations. The nozzle body would consist of a sufficient number and design of orifices to allow the watedjets to contact all areas of the tiedown as shown in FIG. 1.

The advantages of this embodiment are the elimination of abrasives, dust, and other deleterious materials that become disruptive during the cleaning process. The surface to be cleaned receives a superior cleaning and is better prepared to receive additional coatings which protect it from corrosion due to the complete removal of all surface contaminants. The invention allows the watedjets to be in contact with all areas of the tiedowns while containing the effluent water and removed debris.

Another preferred embodiment of the device for removing coatings from deck tiedowns using ultra high pressure watedjets is a means of applying a vacuum to the device that causes it to be suction adhered to the surface. This comprises a pressure receiver chamber, the construction of which will be discussed later, being open at one end to allow the introduction of the ultra high pressure nozzle body to the tiedown. Approximately cylindrical in nature the pressure receiver is closed at one end to contain the vacuum and allow a supporting device that allows the nozzle body to be moved into various positions within the tiedown.

The lower outer perimeter at the open end of the receiver chamber attaches to the deck surrounding the tiedown area having a water sealing means for collecting effluent water and removed debris after impingement on the surface to be cleaned. The water sealing means consists of a reusable flexible sealing surface that conforms to the deck surface allowing all effluent water and materials to be contained within the pressure receiver chamber.

A means of connecting the pressure receiver to a vacuum source through either a flexible or stiff tubing capable of withstanding the vacuum is incorporated into the receiver chamber through an attachment extending through and attached to the wall of the receiver chamber. The effluent water and debris is collected in the pressure chamber and transferred into this tube to a remote vacuum chamber which may be a singular or plurality of components. A means of collecting the water and separating the effluent water and removed solids is incorporated into this invention.

A means of regulating the fluid flow within the pressure receiver is also incorporated into the system. This means consists of an air regulating device attached to the pressure receiver that allows a specified flow of air into the chamber. This system also incorporates a means of interrupting the vacuum applied to the pressure receiver thereby allowing the device to be easily moved from area to area.

The advantages of this embodiment are the complete containment and removal of effluent water and removed debris from the area to be cleaned. The vacuum means continuously removes this material form the tiedown leaving the area ready for recoating. The device minimizes the effects of cleaning the tiedown on the surrounding areas and expedites the recoating maintenance.

Another preferred embodiment of the device for removing coatings from deck tiedowns using ultra high pressure watedjets is a means of controlling the ultra high pressure watedjets and disengaging the energy of these watedjets. This embodiment can be either manually or remotely controlled using either pneumatics, hydraulics, or manual mechanisms either located on the pressure receiver or remote from the device.

Other features and advantages of the invention will become apparent to those skilled in the art from the following detailed description and attached drawings. While the present invention has been described in detail hereinabove by reference to specific embodiments taken in conjunction with the accompanying drawings, it should be understood that the invention is not limited to these embodiments, but various changes and modifications are possible without departing from the scope of the invention.

DETAILED DESCRIPTION OF THE INVENTION

The present inventive subject matter relates to a device and procedure for removing surface coatings from all surfaces of a deck tiedown on marine vessels using ultra high pressure waterjetting with a means of containing all effluent water and debris within a vacuum attached device which seals to the surrounding deck surfaces. More specifically the device will be used to clean the referenced areas to a bare metal condition free of existing paints, corrosion, and contaminants in preparation for receiving a protective coating. The process uses ultra high pressure watedjets delivered through a rotating nozzle body that is completely adjustable in multiple axis and elevations and capable of cleaning all areas of the tiedown.

This nozzle body is contained within a pressure receiver chamber that has a sealing surface that seals the pressure receiver to the surrounding deck. As vacuum is applied to this pressure receiver from a remote source, the effluent jetting water and removed paint debris is vacuumed into an attached tubing after it has been impinged on the surface to be cleaned and removed to a remote vacuum source for treatment.

An ultra high pressure rotating swivel is driven by either hydraulic, pneumatic, or mechanical means. This in turn rotates an ultra high pressure rotational tubing therefore rotating the attached nozzle body. This nozzle body has multiple orifices that are strategically placed on the perimeter of the nozzle body which allow the ultra high pressure watedjets to exit the nozzle and impinge on the surface of the tiedown. These watedjets remove the existing coatings, contaminants, and unwanted materials from the surface of the tiedown. These materials and effluent water are then removed from the pressure receiver by the remote vacuum.

Figure 2:
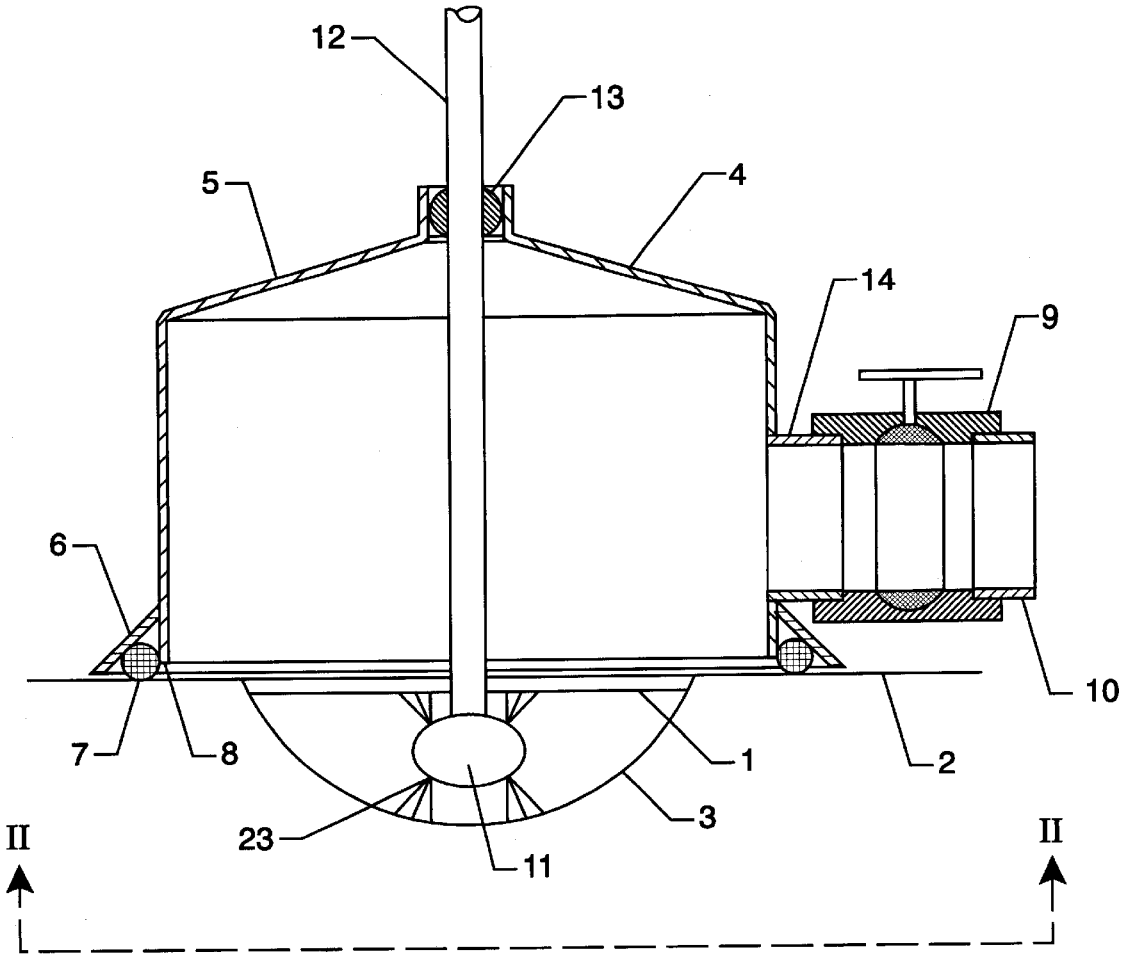
FIG. 2 vacuum device to clean tiedowns

FIG. 2 describes the components that make up the vacuum chamber in which the ultra high pressure waterjetting takes place. The pressure receiver 4 is a cylindrical chamber which is open on one end to allow the introduction of an ultra high pressure nozzle 11 into the tiedown. The pressure receiver is made of any material that can withstand the vacuum that is introduced into it, as well as the contact of the ultra high pressure watedjets to its interior surfaces and the rugged handling generally encountered in a marine atmosphere. The pressure receiver is enclosed at the other end with an opening centrally located to receive a device that allows the nozzle to be manipulated 13. An air regulating device 5 is located in the pressure receiver to allow a regulated quantity of air into the pressure receiver to provide makeup air as the vacuum is maintained inside the pressure receiver. A vacuum attachment 14 penetrates and is attached to the pressure receiver at a point above the outer seal containment. A vacuum valve 9 is attached to this vacuum attachment 14 that is capable of being closed rapidly either manually or remotely to isolate the vacuum from the pressure receiver interior. This allows the vacuum within the pressure receiver to be relieved and the device can be disengaged from the deck to be moved to another location.

Figure 3:
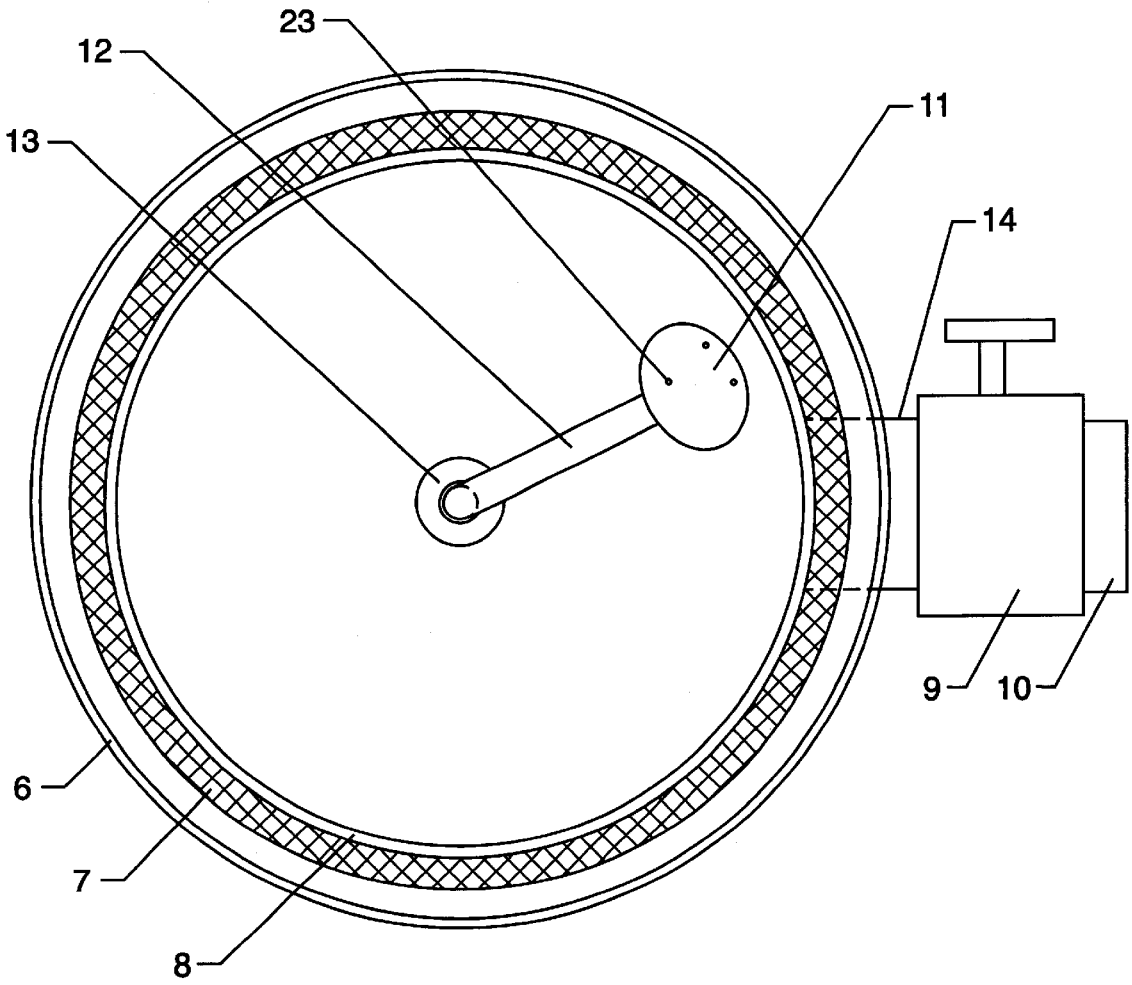
FIG. 3 vacuum seal area

FIG. 3 describes a chamber that is located at the open end of the pressure receiver on the external circumference consisting of a outer seal containment 6 and an inner sealing surface 8. See FIG. 2 also. This chamber holds a flexible seal 7 that is used to seal the device to the surrounding deck when vacuum is applied to the interior of the pressure receiver. The seal extends to the entire circumference of the pressure receiver and is made of any flexible material such as rubber, nylon, plastics, silicone resins, etc. Another embodiment of the device has been used with a sealing surface mounted inside this chamber comprised of brushes using tightly grouped stiff bristles. The drawing also depicts the range of motion the nozzle body 11 has within the pressure chamber.

Figure 4:
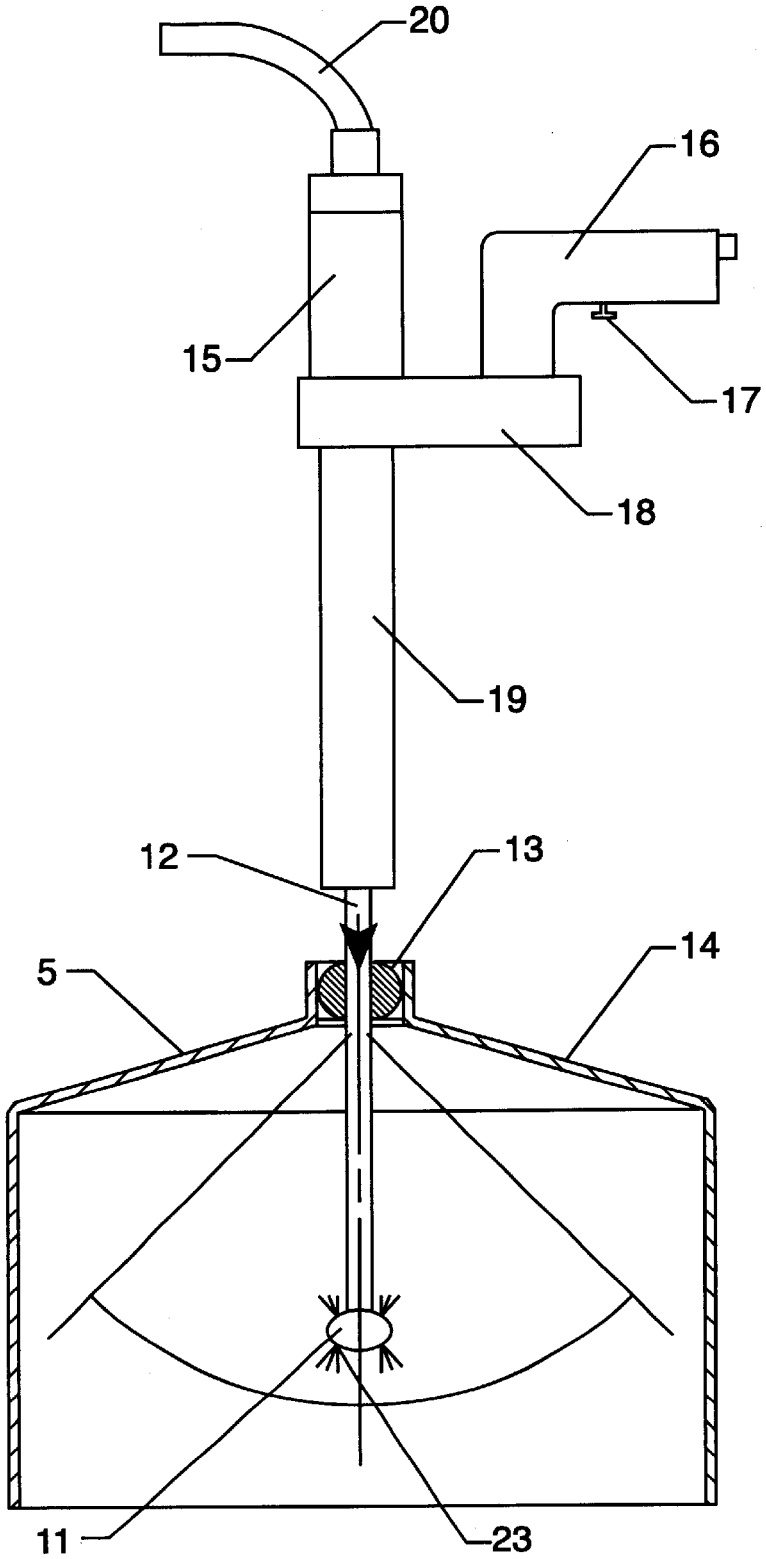
FIG. 4 rotating UHP nozzle, rotation device and nozzle manipulator
Figure 5:
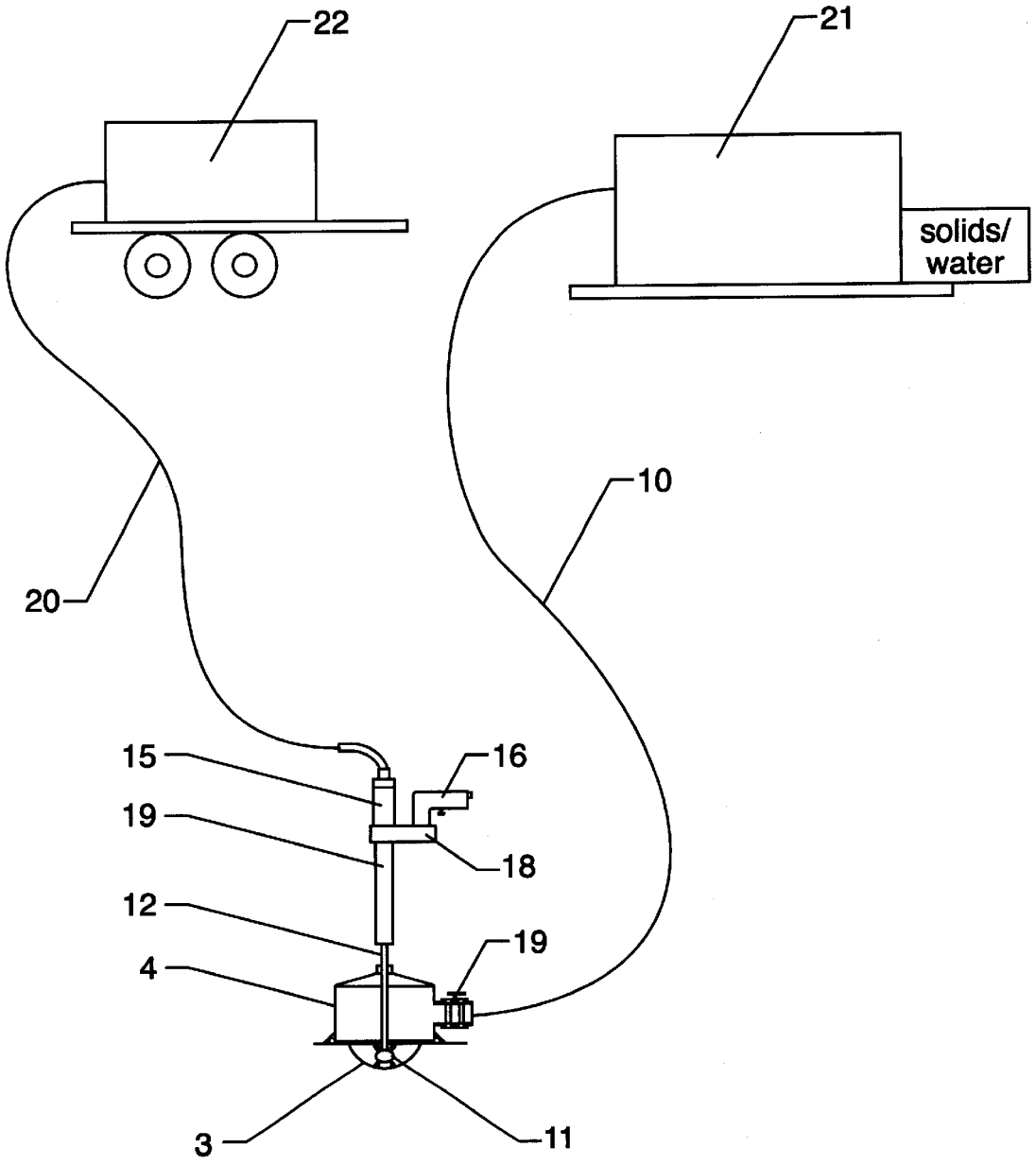
FIG. 5 overview of complete system with remote ancillary equipment
Figure 6:
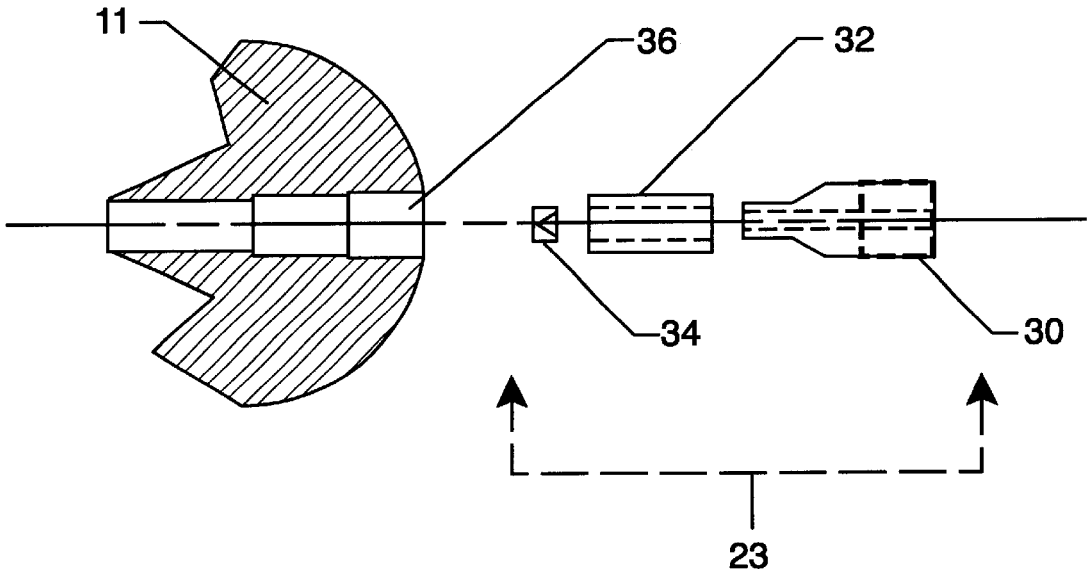
FIG. 6 is an exploded view of the structure of an orifice

FIG. 4 describes the nozzle manipulator mounted in the center of the closed side of the pressure receiver. This nozzle manipulator allows the ultra high pressure rotational tubing 12 and therefore the nozzle body 11 to be manipulated in an arc of approximately 90 degrees included. The inside diameter of the nozzle manipulator 13 provides a slide fit to the outside diameter of the ultra high pressure tubing allowing the tubing and therefore the nozzle body to be manipulated to different elevations within the pressure receiver 4. FIG. 4 and FIG. 5 also depicts a driven ultra high pressure swivel 15 which is connected at one end to an ultra high pressure tubing 20 either flexible or rigid. This tubing delivers ultra high pressure waterjets, defined previously as water pressures above 25,000 PSI, from a remote pump 22 to the ultra high pressure swivel 15. The ultra high pressure water travels from the remote pump 22 through the ultra high pressure tubing 20 into the swivel 15 and into the attached ultra high pressure rotational tubing 12 that leads to the nozzle body 11. This swivel is driven by a rotation device 16 that uses either pneumatics, hydraulics, or manual energy to drive the swivel and therefore rotate the rotational tubing 12 and the attached nozzle body 11. The drive mechanism 18 connects the rotation drive device to the ultra high pressure swivel. A protective shroud 19 is mounted to the front of the drive mechanism and loosely covers the ultra high pressure rotational tubing 12 to provide protection to the operator from the rotating tubing. Another embodiment of this device could use a self-rotating nozzle body that uses angled orifices to rotate the body on an axis. The nozzle body 11 consists of a stainless steel or similar metal that is capable of withstanding the ultra high pressures. The nozzle body is threaded on one end to receive the ultra high pressure rotational tubing 12. Multiple orifices 23 are located at strategic locations on the perimeter of the body to allow the watedjets to contact all areas of the tiedown presented for cleaning. A typical orifice 23 consists of a threaded set-screw 30 that holds a small gasket 32 and an orifice body 34 that is screwed into a threaded receiver 36 on the nozzle body 11.

FIG. 5 is an overview of the complete system showing all remote ancillary equipment. An UHP pump 22 capable of pressures above 25,000 PSI, typically in the 40,000 PSI range, supplies ultra high pressure water through a stiff or flexible tubing 20 to an ultra high pressure swivel. This swivel is rotated and supplies water to the ultra high pressure rotating nozzle body which has multiple orifices 23. The water exits the nozzle body at high velocities, typically in excess of 2400 Ft/sec striking the areas of the tiedown to be cleaned. The water removes unwanted coatings, and contaminants and is collected inside the sealed pressure receiver 4. The remote vacuum system 21 provides vacuum to the pressure receiver 4 through a flexible or rigid tubing 10. The vacuum inside the pressure receiver 4 and the airflow back to the remote vacuum system 21 removes the effluent water and debris to the vacuum system 21 for treatment. The solids are removed from the waste water through either filtration or settling or both and are stored for disposal. This system comprises a closed loop recovery system for removing existing coatings from tiedown surfaces.

I claim:

1. An apparatus for ultra high pressure waterjetting, comprising a pressure receiver having a top opening and a bottom opening, the periphery of the bottom opening having a sealing surface for vacuum adhering the pressure receiver to a deck surface, the pressure receiver also having an air flow regulator;

a nozzle manipulator mounted in the top opening of the pressure receiver, the nozzle manipulator being rotatable about multiple axes in the top opening and having a passageway;

a rotational tubing extending through and being in sliding fit with the passageway of the nozzle manipulator, the rotational tubing having a first end and a second end, wherein the rotational tubing is capable of sliding movement within the passageway of the nozzle manipulator;

a rotating swivel mechanism having a top end and a bottom end, the bottom end being connected to the first end of the rotational tubing and disposed outside the pressure receiver, wherein the rotating swivel mechanism is capable of imparting rotation to the rotational tubing, the top end of the rotating swivel mechanism having a pump connector for attachment to a hose from a water pump;

an ultra high pressure nozzle body connected to the second end of the rotational tubing and disposed inside the pressure receiver, wherein the ultra high pressure nozzle body is capable of vertical movement above and below a plane formed by the bottom opening and is capable of swinging movement through an arc of approximately 90 degrees within the pressure receiver, the nozzle body also being capable of rotational movement due to the attachment to the rotational tubing, the ultra high pressure nozzle body also having a plurality of orifices in the perimeter; and a vacuum attachment connected to a wall opening in the vacuum chamber for controlling flow from the vacuum chamber.

2. The apparatus of claim 1, wherein each of the plurality of orifices includes a set-screw connected to a washer, the washer being further connected to an orifice body.

3. The apparatus of claim 2, wherein the sealing surface is a flexible seal.

4. The apparatus of claim 3, wherein the air flow regulator is a hole through the pressure receiver, the hole being sized to permit a regulated quantity of air into the pressure receiver.

5. The apparatus of claim 4, wherein the orifices in the nozzle body are angled.

6. The apparatus of claim 2, wherein the sealing surface is brushes.

7. An apparatus for ultra high pressure waterjetting, comprising a pressure receiver having a top opening and a bottom opening, the periphery of the bottom opening having a flexible seal for vacuum adhering the pressure receiver to a deck surface, the pressure receiver also having a hole through the pressure receiver, the hole being sized to permit a regulated quantity of air into the pressure receiver;

a nozzle manipulator mounted in the top opening of the pressure receiver, the nozzle manipulator being rotatable about multiple axes in the top opening and having a passageway;

a rotational tubing extending through and being in sliding fit with the passageway of the nozzle manipulator, the rotational tubing having a first end and a second end, wherein the rotational tubing is capable of sliding movement within the passageway of the nozzle manipulator;

a rotating swivel mechanism having a top end and a bottom end, the bottom end being connected to the first end of the rotational tubing and disposed outside the pressure receiver, wherein the rotating swivel mechanism is capable of imparting rotation to the rotational tubing, the top end of the rotating swivel mechanism having a pump connector for attachment to a hose from a water pump;

an ultra high pressure nozzle body connected to the second end of the rotational tubing and disposed inside the pressure receiver, wherein the ultra high pressure nozzle body is capable of vertical movement above and below a plane formed by the bottom opening and is capable of swinging movement through an arc of approximately 90 degrees within the pressure receiver, the nozzle body also being capable of rotational movement due to attachment to the rotational tubing, the ultra high pressure nozzle body also having a plurality of orifices in the perimeter;

a vacuum attachment connected to a wall opening in the vacuum chamber for controlling flow from the vacuum chamber;

means for supplying ultra high pressure water to the rotating swivel mechanism; and means for providing a vacuum in the pressure receiver.

* * * * *